US005210984A

United States Patent [19]

Eckel

[11] Patent Number: 5,210,984

[45] Date of Patent: May 18, 1993

[54] AUDIOMETRIC BOOTH

[75] Inventor: Alan Eckel, Westford, Mass.

[73] Assignee: Eckel Industries, Inc., Cambridge, Mass.

[21] Appl. No.: 906,816

[22] Filed: Jun. 30, 1992

Related U.S. Application Data

[63] Continuation of Ser. No. 517,944, May 2, 1990, abandoned.

[51] Int. Cl.[5] ..... E04B 1/343

[52] U.S. Cl. ..... 52/79.5; 52/265; 52/270; 52/284; 52/588

[58] Field of Search ..... 52/264, 265, 270, 284, 52/79.1, 79.5, 79.6, 588, 593, 595

[56] References Cited

U.S. PATENT DOCUMENTS

| | | | |
|---|---|---|---|
| 1,857,913 | 5/1932 | Judelson | 52/264 |
| 2,280,542 | 4/1942 | Rosendale | 52/264 |
| 2,313,471 | 3/1943 | Hallam | 52/265 |
| 2,927,665 | 3/1960 | Hauf | 52/264 |
| 3,182,767 | 5/1965 | Kuehl | 52/265 |
| 3,236,014 | 2/1966 | Edgar | 52/270 |
| 3,517,468 | 6/1970 | Woods | 52/265 |
| 3,608,260 | 9/1971 | Eckel et al. | 52/588 |
| 4,984,406 | 1/1991 | Friesen | 52/588 |

*Primary Examiner*—Michael Safavi

*Attorney, Agent, or Firm*—Pandiscio & Pandiscio

[57] ABSTRACT

An audiometric booth made from modular acoustic panels is provided. The panels comprise simple yet effective means for connecting the panels together without need for separate fasteners. The simple connector means permit the audiometric booth to be quickly and easily assembled and disassembled without the use of tools, except for attaching the hinges of the door that provides access to the interior of the booth. The panels and associated members coact so that the fully assembled booth has no exposed grooves or openings at the ends or junctions of the various panels and so that the door makes an acoustic seal with the enclosure.

25 Claims, 4 Drawing Sheets

AUDIOMETRIC BOOTH

This application is a continuation of application Ser. No. 07/517,944 filed May 2, 1990 now abandoned.

FIELD OF THE INVENTION

The present invention relates to enclosures for providing a sound-proof environment, and more particularly to such enclosures comprising modular panels that are designed so as to facilitate assembly and disassembly of the enclosures.

BACKGROUND OF THE INVENTION

Acoustical panels are widely used for constructing enclosures that provide an acoustically-isolated environment. Such enclosures typically comprise a plurality of modular acoustical panels interconnected so as to form a back wall, two side walls, a top wall, a bottom wall, and a front wall, with a door being associated with one of the walls. The sound absorbing panels and door include a sound-absorbing material in their interiors.

Heretofore modular acoustical enclosures usually require connector elements of various shapes and complexity for locking the acoustical panels together so as to form the desired wall assembly. U.S. Pat. Nos. 3,608,260, 4,038,796, 4,074,489, and 4,106,255 show prior modular systems for fabricating acoustical enclosures.

One variety of acoustical enclosure is an audiometric booth, so-called because it is used to test the hearing of individuals. One such audiometric booth is manufactured by Eckel Industries, Inc. of Cambridge, Mass. and is identified by model number AB 200. While audiometric booths usually are fabricated from pre-formed acoustical panels, the methods of construction that have been used are such that the common practice has been to preassemble the booths at the place of manufacture.

Systems of the kind disclosed in U.S. Pat. Nos. 3,608,260, 4,038,796, 4,074,489, and 4,106,255 have not been deemed suitable for making audiometric booths, for a variety of reasons. The primary reason is cost. Still other reasons are that they require a relatively large number of assembly operations and/or connector elements, or else they are not designed to permit rapid and easy assembly and disassembly of the audiometric booth by the typical purchasers of such equipment. However, shipping audiometric booths to the customer in fully assembled condition is not fully satisfactory. Because audiometric booths are typically large enough to accommodate at least one person, the transportation costs associated with shipping a pre-assembled booth to the end-user tends to be quite substantial.

Another likely problem when making an audiometric booth using prior modular panel systems of the type described is that the assembled enclosure may have exposed joints or gaps at the junctions of the panels. Such exposed junctions or gaps, in addition to being visually undesirable, may compromise the acoustic integrity of the audiometric booth. For example, audiometric booths manufactured using acoustical wall assemblies as disclosed in U.S. Pat. No. 4,074,489 will normally have one or more exposed grooves, e.g., along one of the edges of the front ends of the side panels.

A further factor tending to inhibit use of some prior modular acoustical panel systems to make an audiometric booth is that the side wall panels are not interchangeable, and instead separate left hand and right hand panels are required in assembling the enclosures. Still another possible reason for not using one or more prior modular panel systems is that, because of design and manufacturing requirements, the determination as to whether the enclosure door is hinged on the right or left must be made at the time of manufacture rather than being a matter of choice at the time of assembly at the intended site of use.

OBJECTS AND SUMMARY OF THE INVENTION

One object of the present invention is to provide an audiometric booth made from modular acoustical panels which may be quickly and easily assembled with few or no tools.

Another object of the present invention is to provide a sound-proof room, e.g., an audiometric booth, comprising a modular wall assembly made up of a plurality of acoustical panels and relatively simple, yet effective, connector means for securing the panels together.

Still another object of the present invention is to provide a sound-proof enclosure, such as an audiometric booth, which does not include any exposed gaps or grooves that will adversely affect the acoustical integrity of the enclosure or materially detract from the aesthetics of its appearance.

These and other objects are accomplished by an enclosure of the type described comprising a plurality of sound-absorbing panels each made up of a pair of parallel plates (preferably made of metal) that are secured in spaced relationship to one another by spacer members, preferably in the form of channel bars, that act as stiffeners. The spacer members extend along and adjacent to the four side edges of the two plates, substantially as shown and described in U.S. Pat. No. 4,074,489 and the references cited therein, and a suitable sound absorbing material such as glass fibers or a plastic foam fills the voids between the two plates and the spacer members. The enclosure comprises a rectangular back panel characterized by having its outer plate project a selected distance beyond the opposite vertical side edges of its inner plate, so as to define elongate planar tabs. The enclosure also includes first and second side panels, each having a flange along each of its two opposite vertical side edges that is positioned so as to form a groove or channel that is open at the inner side of the side panel. The channels are sized to receive the elongate planar tabs of the back panel with a friction fit, whereby the side panels and the back panels may be interconnected to form a U-shaped enclosure. Preferably, the side panels are identical and so may be used interchangeably as either the right or left walls of the enclosure.

The enclosure is completed by top and bottom panels (i.e., ceiling and floor panels) and a front or door panel, with the side and back wall panels being received in grooves in the top and bottom panels so as to provide a soundproof seal along junctures of those panels. The enclosure is closed off by the door panel which is hinged to the front end of one of the side panels and is adapted to make a soundproof seal with the adjacent front ends of the top and bottom panels and the two side panels.

To improve the acoustical integrity of the enclosure and also to improve it appearance, two trim members are inserted into the channels at the front ends of the two side panels when the latter are coupled with the back panels. These trim members conceal and seal off the front edges of the two side panels.

The relatively simple, yet highly effective, design of the means used to secure the panels together to form an enclosure permits an audiometric booth to be assembled relatively quickly in the factory or on site, without use of any tools except for what may be required to for attaching the door hinges. Because of the ease of assembly and disassembly, it is feasible to ship the booth in a "knocked-down" state to the intended site of use, thereby decreasing significantly the transportation costs for shipping such a booth. This mode of doing business is also facilitated by virtue of the fact that the side panels are identical and interchangeable, thus eliminating the need for non-interchangeable left and right side panels.

Other objects of the invention will in part be obvious and will in part appear hereinafter. The invention accordingly comprises the apparatus possessing the construction, combination of elements, and arrangement of parts which are exemplified in the following detailed disclosure. The scope of the application will be indicated in the appended claims.

BRIEF DESCRIPTION OF THE DRAWINGS

For a fuller understanding of the nature and objects of the present invention reference should be made to the following detailed description taken in connection with the accompanying drawings wherein.

In the drawings, like numerals identify like parts.

DETAILED DESCRIPTION OF THE INVENTION

Figure 1:
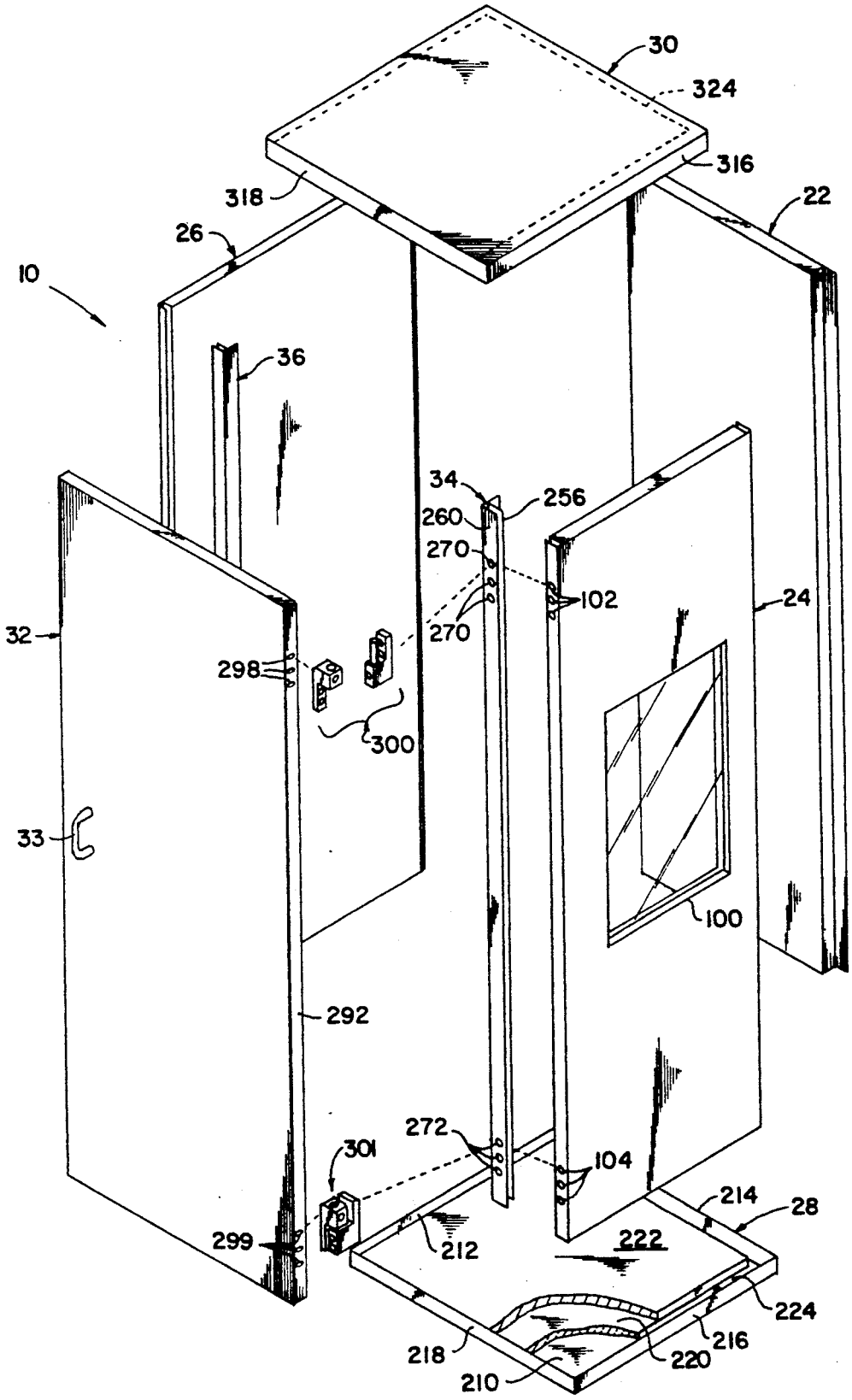
FIG. 1 is an exploded, perspective view of an audiometric booth constituting a preferred embodiment of the present invention.

Referring now to FIG. 1, the illustrated embodiment of the invention is an enclosure in the form of an audiometric booth 10 for providing an acoustically isolated environment in which the hearing of an individual may be tested. Booth 10 comprises a back panel 22, two opposite side panels 24 and 26, bottom panel 28, and top panel 30. The booth also comprises a door 32, trim members 34 and 36, and hinges hereinafter described for mounting the door to one of the two side panels.

Figure 5:
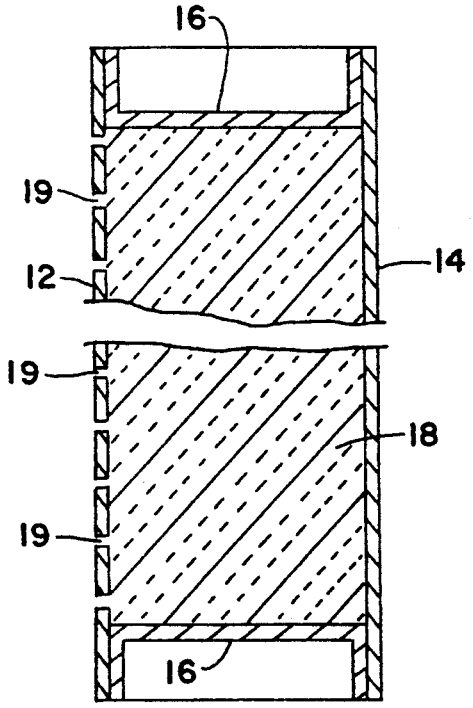
FIG. 5 is a cross-sectional view illustrating a preferred construction for the acoustical panels used in practicing this invention.

Referring now to FIG. 5, the back and side panels that make up the enclosure preferably constitute an inside rectangular plate 12, an outer rectangular plate 14, channel-shaped members 16, and a sound-absorbing filler 18. Although only two channel members 16 are shown in FIG. 5, it is to be understood that each panel has four channel members 16, each of which is disposed between plates 12 and 14 at a different one of the four margins thereof, i.e., members 16 are adjacent to and extend parallel to the four side edges of plates 12 and 14. Depending upon the materials used to make the panels, members 16 are welded, brazed, cemented or otherwise secured to plates 12 and 14 so as to form a unitary structure with those plates. Plates 12 and 14 and members 16 are preferably made of a suitable metal such as steel or aluminum, but they could be made of some other material, e.g., a glass fiber-reinforced plastic. The sound-absorbing filler 18 may take various forms. Thus it may consist of glass fibers, plastic foam or some other suitable material. Preferably the inside plate 12 is perforated as shown by holes 19 so as to facilitate transmission of sound emanating from within the enclosure to the sound-absorbing filler 18. However, the outside plate 14 is preferably imperforate.

Figure 2:
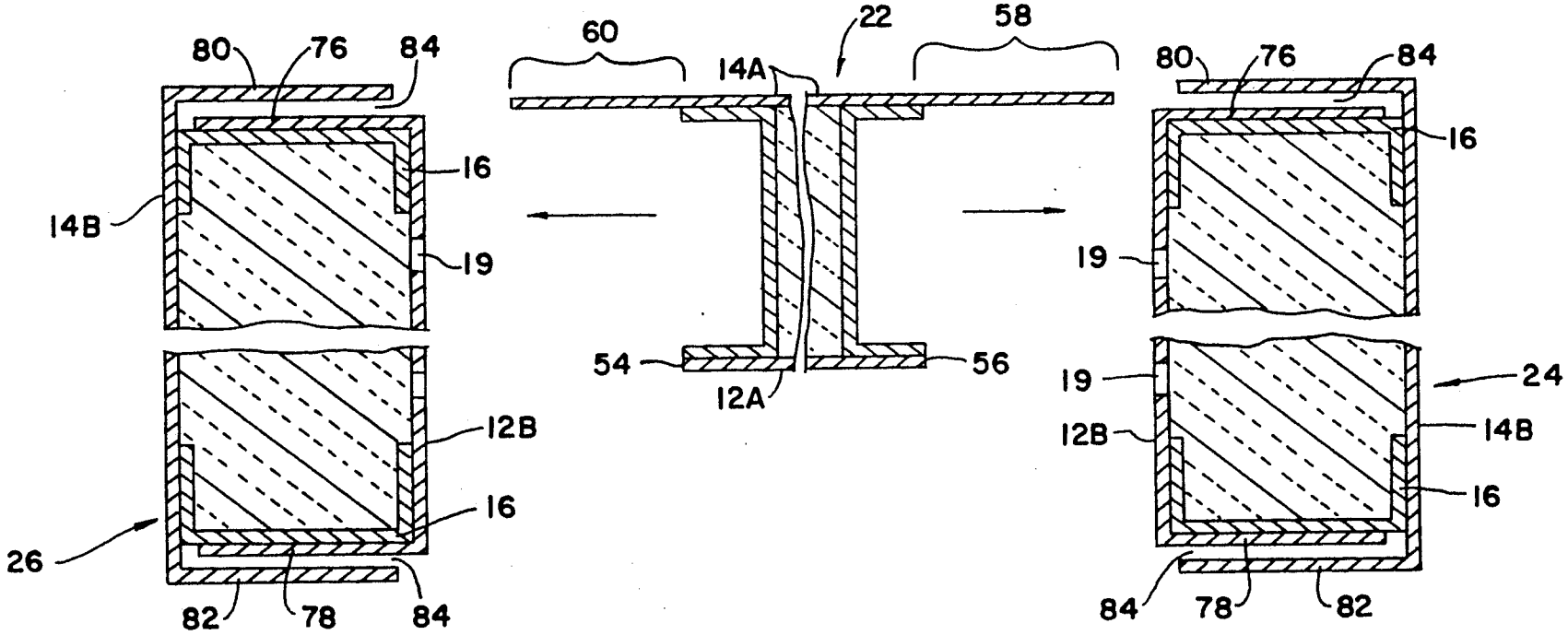
FIG. 2 is an exploded cross-sectional view of the side panels and the back panel of the same audiometric booth.

Referring now to FIG. 2, the outer wall or plate 14A of back panel 22 is sized so that it projects laterally a selected distance, typically ranging from 0.25 inches to 0.75 inches, beyond the side edges 54 and 56 of inner plate 12A. These projecting portions of the outer wall 14A define planar elongate tongues or tabs 58 and 60.

Still referring to FIG. 2, side panels 24 and 26 comprise inner walls or plates 12B and outer walls or plates 14B. Each of the inner walls 12B is formed with right-angle extensions 76 and 78 along its two vertical side edges that are welded to channel members 16 and serve as the side walls of panels 24 and 26. The outer walls 14B have flanges in the form of right-angle extensions 80 and 82 that extend parallel to but are spaced from extensions 76 and 78 of panel 24 so as to form front and rear channels 84. Flanges 80 and 82 extend across or nearly across the width of side panels 24 and 26. The width of channels 84 is sized so as to be about equal to, or slightly less than, the thickness of the elongate tabs 58 and 60 that extend along the two vertical side edges of rear panel 22. As a consequence, when the tabs are inserted into the rear channels 84, they will make a friction fit with the side wall 76 (or 78) and the flange 80 (or 82) of the adjacent side panel.

It is to be noted that side panels 24 and 26 need not be solid. Instead one or both of those panels may be provided with a window, as illustrated by window 100 in FIG. 1. Window 100 is preferably made and installed in the manner described in U.S. Pat. No. 4,074,489. The window is preferably centered between the top and bottom margins of the side panel, so as to facilitate the use of that panel as either of two side panels of the enclosure.

Figure 3:
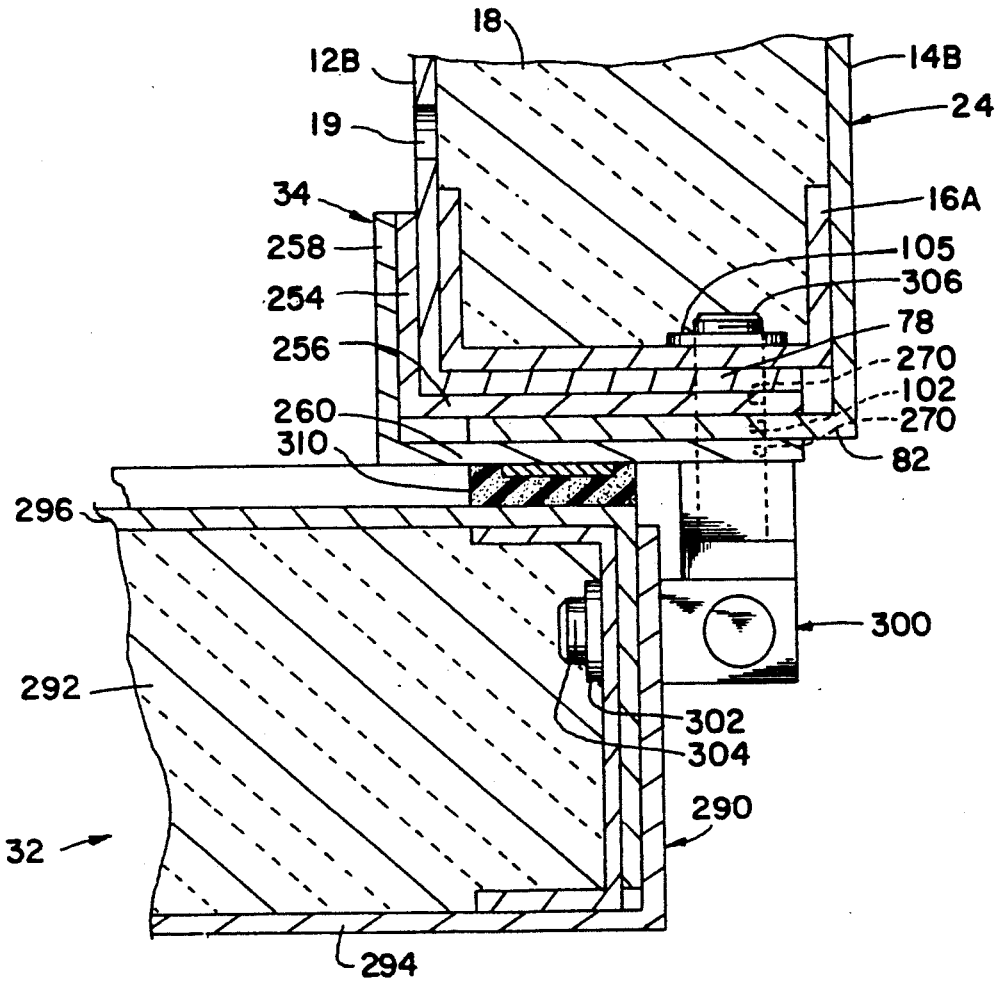
FIG. 3 is a cross-sectional view of one end of one of the side panels showing the door and hinge assembly for mounting the door to the side panel.

Referring to FIG. 3, the two side panels 24 and 26 each have two groups of apertures 102 that extend through flanges 82, extensions 78 and the adjacent channel member 16A. A threaded nut 105 is attached to the inside surface of channel member 16A in alignment with each aperture 102.

Referring to FIG. 1, bottom panel 28 comprises a bottom plate 210 formed integral with four vertically extending side walls 212, 214, 216 and 218, and a floor unit comprising a sheet 220 of sound-absorbing material covered and reinforced with a perforated metal floor plate 222. The floor unit is preferably cemented to bottom plate 210 and is disposed so that it abuts the front side wall 218 but is spaced from side walls 212, 214, 216 so as to form a groove 224 defined by the floor unit, bottom plate 210 and side walls 212, 214, 216. Groove 224 is U-shaped in plan view so as to accommodate the bottom ends of rear panel 22 and side panels 24 and 26. The width and depth of groove 224 are set so that the bottom end portions of the side and back panels will make a tight fit in that groove and will be captivated between the floor unit and walls 212, 214, 216 of bottom panel 28. By sizing bottom panel 28 and groove 224 in this manner, the side panels are prevented from separating from the back panel.

Top panel 30 is virtually identical to bottom panel 28, except that it is disposed upside down relative to the bottom panel. It is formed with the U-shaped groove 324 extending inside of its rear and side walls, such as side wall 316, but does not extend adjacent the front wall 318. Top panel 30 is oriented so that its groove 324 can accept the upper end portions of back panel 22 and side panels 24 and 26. Top panel 30 is forced down over the upper ends of panels 22, 24 and 26, with the upper ends of those panels making a friction fit in groove 324. Once top panel 30 has been set in place, the back and two side panels are firmly locked together, providing a sturdy enclosure.

Figure 4:
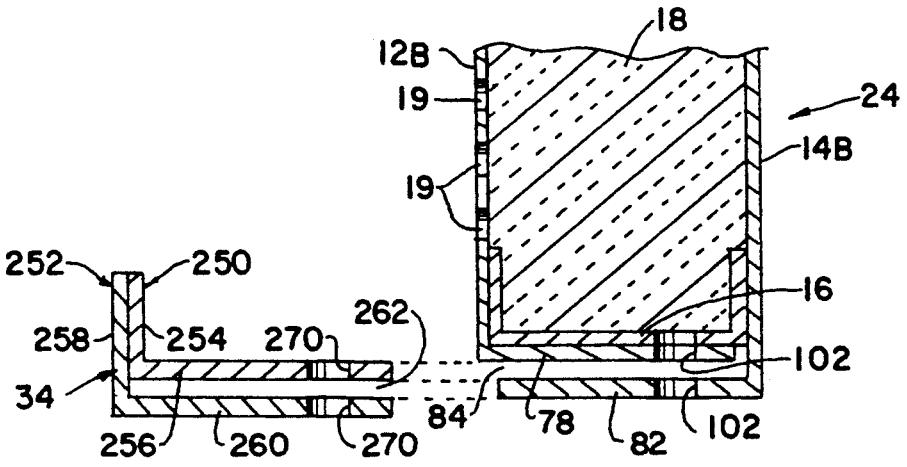
FIG. 4 is an exploded cross-sectional view of one end of one of the side panels of the audiometric booth showing the trim piece for covering the groove in the ends of the side panel.

Referring to FIGS. 1 and 4, trim members 34 and 36 are identical, except as otherwise noted hereinafter. Each trim member has two functions. One function is to improve the aesthetic appearance of the front end of the two side panels. The other function is to provide a better barrier to sound transmission between the edges of the door and the enclosure. The two trim members extend the front faces of the two side panels so that they are flush with the front walls 218 and 318, respectively, of floor panel 28 and top panel 30, thereby assuring a uniform fit of the door gasket hereinafter described.

As seen best in FIGS. 1 and 4, trim member 34 comprises two elongate members 250 and 252 having L-shaped cross-sections. Member 250 comprises a relatively narrow flat bar-like section 254 and a relatively wide flat bar-like section 256 at right angles thereto. Member 252 comprises a relatively narrow flat bar-like section 258 and a relatively wide flat bar-like section 260 at right angles thereto. Section 254 of member 250 is welded or otherwise bonded to section 258 of member 252, while section 256 extends parallel to but spaced from section 260 of member 252, whereby to form a channel 262. Trim members 34 and 36 are attached to side walls 24 and 26 by sliding their relatively wide sections 256 into front channels 84 so that their other relatively wide sections 260 overlap and engage flanges 82. In practice, the trim members are sized so that their portions 256 make a tight fit in channels 84 and flanges 82 of the side panels make a tight fit in channels 262, thereby eliminating the need for any additional means for attaching the trim members to the side panels. It should be noted that the two trim members 34 and 36 ar made shorter than side panels 24 and 26 so as not to interfere with insertion of those panels in grooves 224 and 324, respectively of the top and bottom panels. Preferably the difference in length is set so that when the side panels are received in bottom panel 28 and top panel 30, the lower and top ends of trim members 34 and 36 will be immediately adjacent to or engage the side walls 218 and 318, respectively and the floor and ceiling units of the bottom and top panels 28 and 30 respectively.

The two trim members are identical except that one of them is provided with holes for mounting of hinges. In the embodiment shown in the drawings (FIG. 1), trim member 34 includes two groups of apertures 270 and 272 which are disposed so as to be aligned with apertures 102 and 104 when the trim member is mounted to side panel 24.

The door 32 is sized so that when it is mounted by hinges to the front end of side panel 24, it will overlap the two side panels and the top and bottom panels. The structure of the door is not shown or described in detail, since various door constructions may be used in practicing the present invention. However, preferably the door is made so that it comprises a frame 290 formed by front and back surface sheets 294 and 296 that contain a layer of sound absorbing material 292 therewithin. Preferably the door frame is made of metal, in the same manner as panels 22, 24 and 26, and the inside surface sheet 294 is perforated like the inside plates 12 of the two side panels.

As shown in FIG. 1, two groups of apertures 298 and 299 are provided in one long side of frame 292. These apertures are for use in attaching two hinges 300 and 301 to the door. In this connection it should be noted that the booth shown in the drawings is provided with a door that is hinged at its right hand side; consequently a handle 33 is attached to the left hand side of the door to facilitate opening it. Although it is not necessary, it is preferred that hinges 300 and 301 be of a type that is known as a reversible or universal hinge. A nut 302 (FIG. 3) is secured to the inner side of the door frame in alignment with each aperture 298, in the same manner as nut 104 is mounted inside panel 24.

Hinges 300 and 301 are secured to door 32 by means of threaded bolts such as bolt 304 (FIG. 3) which are screwed into nuts 302. The other ends of hinges 300 and 301 are secured to side panel 24 by means of bolts such as bolt 306 that extend through apertures 270 and 102 and screw into nuts 104.

Audiometric booth 10 also includes a conventional magnetic seal 310 (FIG. 3) which is attached to the door 32 so as to extend around the entire peripheral edge of the inside face 296 of the door. The seal makes full contact with the front walls 318 and 218 of the top and bottom panels, respectively, and also with the front surfaces of the flanges 260 of trim members 34 and 36, thus assuring a good acoustic seal between the door and the enclosure.

To expand on the advantages of the invention, one method of assembling the booth shown in FIGS. 1–4 will now be described. It should be appreciated, however, since back panel 22 and side panels 24 and 26 are symmetrical as measured about an axis extending along the long dimension of the panels bisecting the short dimension of the panels, the side and back panels may be positioned in different positions relative to one another. As a first step in assembling audiometric booth 10, tab 58 is inserted in channel 84 in side panel 24. Next, tab 60 on back panel 22 is inserted into channel 84 in side panel 26. Side panels 24 and 26 are moved up or down if required, so that their top ends lie along the same plane as the top end of back panel 22.

Thereafter, the U-shaped enclosure formed by this assembly of back panel 22 and side panels 24 and 26 is inserted into groove 224 in bottom panel 28 and then the top panel is dropped over the foregoing structure so that the top ends of back panel 22 and side panels 24 and 26 extend fully into groove 224 to 324 of the top panel. When assembled in this manner, the side and back panels are locked together by disposition of tabs 58 and 60 in channels 84 and also by disposition of the back and side panels in the grooves 224 and 324 of bottom and top panels 28 and 30, respectively. Then, members 34 and 36 are attached to side panels 24 and 26, respectively, by inserting the bar-like sections 256 into front channels 84. The trim members make a friction fit with the side panels, so that no additional fasteners are required to secure them in place.

Next door 32, with hinges 300 and 301 already attached thereto, is mounted to side panel 24 by passing bolts 306 through the mounting holes in the hinges, trim member apertures 270, and apertures 102 in the side panel, and screwing the bolts into nuts 104.

As noted above, one important advantage of the present invention is that side panels 24 and 26 may be used interchangeably as the left or right walls of the audiometric booth 10 merely by turning the panels upside down (from the perspective of FIG. 1) and moving them to the opposite side of the booth. Similarly, back panel 22 may be rotated 180 degrees about an axis perpendicular to its plane, since the back panel is symmetrical in the side-to-side sense.

Yet another advantage of the present invention is that by installing trim members 34 and 36 in the manner described above, virtually no gaps, openings or grooves are exposed to view or exist when the audiometric booth is fully assembled. As a consequence, the booth is more aesthetically appealing, and the possibly of external sounds entering the interior of the booth is reduced.

Yet another important advantage of the present invention is that because all the panels of audiometric booth 10 are flat, and because the connector means used to attach the panels together are relatively simple and do not require the use of tools (except for attaching the hinges), audiometric booth 10 may be shipped to a customer in a knocked-down state. As a consequence, shipping costs, which may be relatively large for prior art audiometric booths (especially those sized to accommodate two or more persons), are reduced. Moreover, because the present audiometric booth 10 is so easily assembled and disassembled, it may easily be transported by an end-user from one site to another.

Still another advantage of this invention is that the door 32 may be provided with duplicate sets of holes 298 and 299, so that simply by reversing side panels 24 and 26 it is possible to shift the hinge axis from the right hand side of the door as shown to the left hand side, and to do so at the site where the booth is to be used.

As used herein, the term "sound-proof enclosure" is intended to denote an enclosure having sound absorbing walls whereby transmission of acoustical energy through those walls from within the enclosure to the outside environment, or from the outside environment to the interior of the enclosure, is substantially or totally eliminated. Also as used herein, the terms "panel" and "acoustical panel" denote a multi-layer panel intended for use as a wall or door that is designed so as to function as a sound energy barrier, whereby transmission of sound energy through the panel is substantially or totally prevented by reflection, absorption, or both. Similarly the terms "modular panels" and "modular acoustical panels" are intended to denote panels that are used together to form an enclosure or wall assembly, while the term "wall assembly" denotes a linear or angular wall construction consisting of a plurality of wall panels. As used herein in connection with the construction of the panels, the term "plate" denotes a planar member that acts as the interior or exterior skin or surface of the panel. Also the terms "sound absorbing material" and "sound absorbing medium" are to be construed as embracing various kinds of sound-absorbing materials known to persons skilled in the art as being suitable for constructing panels for practicing the present invention.

Since certain changes may be made in the above apparatus without departing from the scope of the invention herein described, it is intended that all matter contained in the above description or shown in the accompanying drawings shall be interpreted in an illustrative and not in a limiting sense.

What is claimed is:

1. A sound proof enclosure of modular construction comprising:

a back panel having opposed side edges;

two opposed side panels;

said back panel comprising inner and outer mutually spaced plates, a sound absorbing medium between said plates, and first and second tabs projecting from the opposite side edges of said back panel, said tabs being integral parts of the outer one of said mutually spaced plates;

each of said two opposed side panels having first and second opposite side edges extending parallel to the opposite side edges of said back panel, each of said side panels comprising inner and outer mutually spaced plates, a sound absorbing medium between said plates, and first and second flanges located at said first and second opposite side edges of said side panels respectively, said first flange forming a first channel between itself and said side panel and said second flange forming a second channel between itself and said side panel;

said first tab of said back panel projecting into said first channel of said first side panel and said second tab of said back panel projecting into said first channel of said second side panel, said first and second tabs each making a friction fit with said side panels so as to secure said side panels to said back panel.

2. Apparatus according to claim 1 wherein portions of said outer plates of said back panel project beyond said inner plate of said back panel at said opposite side edges of said back panel, whereby the projecting portions of said outer plate constitute said first and second tabs.

3. Apparatus according to claim 1 wherein said first and second channels extend for substantially the full height of said first and second side panels.

4. Apparatus according to claim 1 further comprising first and second trim members having flat sections inserted in said second channels to improve the acoustical isolation capability of said enclosure.

5. Apparatus according to claim 4 wherein said flat sections of said trim members make a tight fit in said second channels.

6. Apparatus according to claim 4 wherein each of said first and second trim members has an L-shaped cross-sectional configuration, with one portion of each trim member extending into said second channel and a second portion extending parallel to and engaging the inner plate of said side panel.

7. Apparatus according to claim 1 further comprising a top panel having four side walls, a top wall, and a groove extending along three of said side walls, and further wherein said back panel and said first and second side panels extend into said groove and make a close fit therewith, so as to secure said top panel to said back panel and said first and second side panels.

8. Apparatus according to claim 7 further comprising:

a bottom panel comprising four side walls and a groove extending along three of said side walls, with said two side panels and said back panel extending into and making a close fit with said groove of said bottom panel so as to secure said bottom panel to said back panel and said two side panels.

9. Apparatus according to claim 8 further comprising:

a door panel; and hinge means for attaching said door panel to one of said first and second trim members so that said door panel can swing into and out of closing relation with the front end portions of said top and bottom panels and said two trim members.

10. An audiometric enclosure comprising:

a rectangular back panel comprising front and back wall plates secured together in parallel spaced relation, and a sound absorbing medium between said front and back wall plates;

first and second rectangular side panels, each comprising inner and outer wall plates having first and second oppositely located vertically-extending side edges; and connector means for attaching said side panels to said back panel so as to define a U-shaped enclosure, said connector means comprising a right-angle flange at said first side edge of each of said outer wall plates, said flange coacting with said inner wall plate to define a groove, and tabs on said back wall plate of said back panel extending into said grooves, said tabs and grooves being so sizes as to make a tight fit with said side panels.

11. Apparatus according to claim 10 wherein said first and second side panels have an additional groove at each of said second side edges, and further including first and second barrier means extending into said additional grooves so as to improve the appearance and the acoustical isolation capability of said enclosure.

12. Apparatus according to claim 11 further including a door panel and hinge means securing one side edge of said door panel to one of said side panels so that said door panel can swing open or closed relative to the other side panel, and further wherein said hinge means are secured to said one side panel by fastener means that extend through one of said barrier means.

13. An audiometric enclosure of modular construction comprising:

a rectangular back panel formed of:

inner and outer plates spaced apart from one another, said plates having side edges and end edges;

a sound absorbing medium between said inner and outer plates;

horizontally extending tab members projecting out from each side edge of the outer plate of said back panel, said tab members extending the full length of said panel;

two opposed rectangular side panels assembled to and coextensive with said back panel;

each of said side panels being formed of inner and outer plates having a sound absorbing medium therebetween;

said plates of each side panel having front and rear side edges and opposite end edges, each of said front and rear side edges having a flange spaced from the remainder of said each side panel to form front and rear blind channels opening inwardly towards the inner plate;

said tab members extending into the rear channels of said side panels in a friction fit;

first and second trim members coextensive with said side panels;

each of said trim members having a generally L-shaped cross-sectional configuration, the short portion of said L-shaped trim member extending parallel to and adjacent the inner plate of the side panel and the longer portion of said L-shaped trim member being a bifurcated flange having an inner and an outer leg, the inner leg extending into the front channel of said side member and the outer leg extending parallel to and over the front side edge of said side panel;

a rectangular door panel formed of inner and outer plates spaced apart from one another with sound absorbing medium located therebetween, said plates having side edges and end edges;

hinge means affixed to one side edge of said door panel and to the front side edge of one of said side panels having one of said trim members affixed thereto;

a top and a bottom panel each comprising an outer plate having four upstanding side walls and an inner plate located within said outer plate but spaced therefrom, with sound absorbing medium located between said plates;

said sound absorbing medium and inner plate being spaced from three of said side walls to form a continuous groove extending along said three side walls;

one of the said end edges of said back panel and said side panels extending into and making a close fit within the groove formed in the top panel and the other of the said end edges of said back panel and said side panels extending into and making a close fit within the groove formed in the bottom panel, whereby the top and bottom panels are secured to the back panel and said two side panels; and the end edges of said door panel extending over the upstanding walls of said top and bottom panel which do not have the groove behind them; whereby there is provided an enclosure using interchangeable parts which is capable of being transported in disassembled condition and erected quickly and easily.

14. An audiometric enclosure of modular construction comprising:

a rectangular back panel comprising inner and outer plates spaced apart from one another, said plates having side edges and top and bottom end edges, a sound absorbing medium between said plates, and horizontally extending tab members projecting from each side edge of the outer plate of said back panel, said tab members extending substantially the full length of said panel;

first and second opposed rectangular side panels disposed at opposite side edges of said back panel at right angles thereto, each of said side panels being formed of inner and outer plates with a sound absorbing medium therebetween, each of said inner and outer plates of said side panels having front and rear side edges and top and bottom edges, and said outer plates of said side panels having a right angle flange at said front and rear side edges thereof, with said flanges at said front and rear side edges being disposed so as to from front and rear blind channels respectively that are open on the side of said inner plate of said side panel;

said tab members extending into said rear channels of said side panels in a friction fit;

first and second trim members each having a right angle cross-sectional configuration, with one portion of each trim member extending parallel to and adjacent the inner plate of the adjacent side panel and another portion of said trim member constituting a bifurcated flange characterized by an inner and an outer leg, the inner leg extending into said front channel of said adjacent side panel and the flange forming said front channel extending between said inner and outer legs of said trim member;

a rectangular door panel formed of inner and outer plates spaced apart from one another with sound absorbing medium located therebetween, said plates having side edges and upper and lower end edges;

hinge means comprising a first member affixed to said door panel adjacent one if its side edges and a second member affixed to the inner and outer legs of one of said trim members and the adjacent side panel;

a top panel and a bottom panel each comprising an outer plate having four vertical side walls and an inner plate located within said outer plate but spaced therefrom, with a sound absorbing medium located between said inner and outer plates, said sound absorbing medium and inner plate being spaced from three of said side walls so as to form a groove extending along said three side walls, said sound absorbing medium and said inner plate also extending to the fourth one of said four side walls;

said upper end edges of said plates of said back panel and each of said side panels extending into and making a close fit with the groove formed in the top panel and said bottom end edges of said plates of said back panel and said side panels extending into and making a close fit within the groove formed in the bottom panel, whereby the top and bottom panels are secured to the back panel and said two side panels; and said door panel being sized so that when it is in closed position its top and bottom end edges overlap said fourth side walls of said top and bottom panels respectively, whereby there is provided an enclosure using interchangeable parts which is capable of being transported in disassembled condition and erected quickly and easily.

15. An enclosure of modular construction comprising:

a back panel and first and second side panels;

said back panel comprising (a) a back panel inner wall and a back panel outer wall in the form of first and second rectangular plates respectively, and (b) first spacer members disposed between and secured to said first and second plates, each of said first and second plates having a top edge, a bottom edge, and first and second side edges;

said first and second plates being disposed so that the top, bottom and first and second side edges of said second plate are parallel with the corresponding edges of said first plate and said second plate being sized so that first and second margin portions of said second plate including said first and second side edges thereof project laterally beyond said first and second side edge respectively of said first plate so as to constitute first and second elongate planar tongues;

said first and second side panels each comprising (a) an inner wall and an outer wall in the form of third and fourth rectangular plates respectively, and (b) a plurality of second spacer members disposed between and secured to said third and fourth plates, said third and fourth plates having a top edge and a bottom edge and being disposed so that said top and bottom edges of said third plate are aligned with the corresponding edges of said fourth plate, said third plate having first and second right angle extensions at opposite side edges thereof secured to selected ones of said second spacer members that extend at a right angle to the top and bottom edges of said third and fourth plates, said fourth plate having third and fourth right angle extensions at opposite side edges thereof that extend parallel to but are spaced from said first and second right angle extensions of said third plate, whereby to form a first side channel between said first and third right angle extensions and a second side channel between said second and fourth right angle extensions; and said side panels being disposed parallel to one another and at a right angle to said back panel, with said first and second tongues being disposed within said first channels respectively so as to interlock said back panel to said side panels.

16. An enclosure according to claim 15 wherein at least two of said first spacer members each comprises two parallel spaced side wall sections each having first and second edges and a connecting wall section extending at a right angle to and formed integral with said parallel side wall sections at the first edges thereof, whereby said wall sections coact to define a channel of rectangular cross-section open at said second edges of said parallel side wall sections, and further wherein first and second ones of said at least two first spacer members extend lengthwise of and are located adjacent to said first and second side edges respectively of said first plate.

17. An enclosure according to claim 16 wherein said first and second ones of said at least two first spacer members are oriented so that the open side of said channels thereof face away from one another.

18. An enclosure according to claim 17 wherein at least two of said second spacer members each comprises two parallel spaced side wall sections each having first and second edges and a connecting wall section extending at a right angle to and formed integral with said parallel side wall sections at the first edges thereof, whereby said wall sections coact to define a channel of rectangular cross-section open at said second edges of said parallel side wall sections, and further wherein first and second ones of said at least two first spacer members extend lenghtwise of and are located adjacent to said first and second side edges respectively of said third and fourth plates.

19. An enclosure according to claim 18 wherein said first and second ones of said at lest two second spacer members are oriented so that the open sides of said channels thereof face one another.

20. An enclosure according to claim 19 wherein all of said spacer members are channel members.

21. An enclosure according to claim 20 wherein all of said spacer members and all of said plates are made of metal and are welded to one another.

22. An enclosure according to claim 21 further including a top panel and a floor panel interlocked with the top and bottom edges respectively of said back panel and said side panels, said side panels coacting with said top panel and said floor panel to definge a door opening for said enclosure.

23. An enclosure according to claim 22 further including first and second elongate trim members each comprising first, second and third flat wall sections with said second and third flat wall sections being attached to and extending at a right angle to said first flat wall section, said second flat wall section being located at one longitudinal edge of said first flat wall section and said third flat wall section being located at an intermediate portion of said first flat wall section in spaced relation to said second flat wall section, said first and second trim members being disposed so that said third flat wall section thereof extends within said second channels and make a friction fit with said first and second side panels, whereby to secure said trim members to said side panels.

24. An enclosure according to claim 23 wherein said trim members are sized so as to terminate short of the top and bottom edges of said side panels, and said back panel and said side panels extend into grooves in said top panel and said floor panel.

25. An enclosure according to claim 23 further including a door sized to close off said door opening, hinge means for pivotally attaching said door to said first trim member, and a seal carried by said door for engaging and making an acoustical seal with said trim members, said top panel and said floor panel when said door is moved to closed position.

* * * * *

UNITED STATES PATENT AND TRADEMARK OFFICE

CERTIFICATE OF CORRECTION

PATENT NO. : 5210984

DATED : May 18, 1993

INVENTOR(S) : Alan Eckel

It is certified that error appears in the above-identified patent and that said Letters Patent is hereby corrected as shown below:

Column 6, line 59, delete "224 to".

Claim 2, column 8, line 37, "plates" should be -- plate --.

Claim 10, column 9, line 28, "sizes" should be -- sized --.

Claim 15, column 11, line 67, "edge" should be -- edges --.

Signed and Sealed this

Twenty-first Day of December, 1993

Bruce Lehman

*Attest:*

BRUCE LEHMAN

*Attesting Officer*

*Commissioner of Patents and Trademarks*